US011019971B2

(12) United States Patent
Zhang

(10) Patent No.: US 11,019,971 B2
(45) Date of Patent: Jun. 1, 2021

(54) CONDUCTIVE TELESCOPIC TUBE, AND HAND-HELD VACUUM CLEANER

(71) Applicant: Suzhou Aijian Electric Appliance Co., Ltd., Jiangsu (CN)

(72) Inventor: Yuqi Zhang, Jiangsu (CN)

(73) Assignee: Suzhou Aijian Electric Appliance Co., Ltd., Jiangsu (CN)

( * ) Notice: Subject to any disclaimer, the term of this patent is extended or adjusted under 35 U.S.C. 154(b) by 367 days.

(21) Appl. No.: 16/073,803

(22) PCT Filed: Sep. 22, 2016

(86) PCT No.: PCT/CN2016/099665
§ 371 (c)(1),
(2) Date: Jul. 29, 2018

(87) PCT Pub. No.: WO2017/128740
PCT Pub. Date: Aug. 3, 2017

(65) Prior Publication Data

US 2019/0029485 A1 Jan. 31, 2019

(30) Foreign Application Priority Data

Jan. 29, 2016 (CN) ..... 201610063853.9

(51) Int. Cl.
*A47L 9/24* (2006.01)
*A47L 5/24* (2006.01)

(52) U.S. Cl.
CPC ..... *A47L 9/246* (2013.01); *A47L 5/24* (2013.01); *A47L 9/24* (2013.01); *A47L 9/244* (2013.01); *A47L 9/248* (2013.01)

(58) Field of Classification Search
CPC . A47L 9/246; A47L 9/24; A47L 9/244; A47L 9/248; A47L 5/24; A47L 5/28
See application file for complete search history.

(56) References Cited

U.S. PATENT DOCUMENTS 5,740,586 A * 4/1998 Gomas ..... B25G 1/10 16/430
2002/0020541 A1* 2/2002 Stein ..... A47L 9/244 174/47

(Continued)

FOREIGN PATENT DOCUMENTS

CN 1150535 5/1997
CN 2623157 7/2004

(Continued)

OTHER PUBLICATIONS

"International Search Report (Form PCT/ISA/210)", dated Jan. 5, 2017, with English translation thereof, pp. 1-6.

*Primary Examiner* — David Redding
(74) *Attorney, Agent, or Firm* — JCIPRNET

(57) ABSTRACT

Disclosed are a conductive telescopic tube and a hand-held vacuum cleaner, the conductive telescopic tube includes a plurality of sleevings capable of extending-retracting with respect to each other, and conductive assemblies disposed on each of the sleevings and capable of being connected with each other, and the conductive assemblies include mounting seats disposed on one side of the sleevings along a length direction of each of the sleevings, contact strips disposed along a length direction of the mounting seat, and a conductive joint conductively connecting every two adjacent of the contact strips respectively, wherein every two adjacent of the mounting seats are telescopically disposed, two end portions of the conductive joint are respectively located within two adjacent mounting seats, and capable of always conductively connecting the two adjacent contact strips. The hand-held vacuum cleaner includes a vacuum cleaner body, a dust suction head and the conductive telescopic tube.

10 Claims, 6 Drawing Sheets

(56) References Cited

U.S. PATENT DOCUMENTS

| | | | |
|---|---|---|---|
| 2007/0295571 | A1 | 12/2007 | Tong |
| 2014/0042739 | A1 | 2/2014 | Zeng |

FOREIGN PATENT DOCUMENTS

| | | |
|---|---|---|
| CN | 2843329 | 12/2006 |
| CN | 2848085 | 12/2006 |
| CN | 2879936 | 3/2007 |
| CN | 101018498 | 8/2007 |
| CN | 201055349 | 5/2008 |
| CN | 201150510 | 11/2008 |
| CN | 101453933 | 6/2009 |
| CN | 201558054 | 8/2010 |
| CN | 102121492 | 7/2011 |
| CN | 203354465 | 12/2013 |
| CN | 204995371 | 1/2016 |
| CN | 105534410 | 5/2016 |
| CN | 205386120 | 7/2016 |
| JP | 1998248773 | 9/1998 |
| JP | 4155673 | 9/2008 |

* cited by examiner

CONDUCTIVE TELESCOPIC TUBE, AND HAND-HELD VACUUM CLEANER

CROSS-REFERENCE TO RELATED APPLICATION

This application is a 371 application of an international PCT application serial no. PCT/CN2016/099665, filed on Sep. 22, 2016, which claims priority to and the benefit of China Patent Application No. 201610063853.9, filed on Jan. 29, 2016. The entirety of each of the abovementioned patent applications is hereby incorporated by reference herein and made a part of this specification.

TECHNICAL FIELD OF THE INVENTION

The present disclosure relates to a hand-held vacuum cleaner, and a conductive telescopic tube of a vacuum cleaner.

BACKGROUND OF THE INVENTION

As is well known, a hand-held vacuum cleaner basically comprises a main vacuum cleaner body, a dust suction head (floor brush), and a dust suction tube connecting the dust suction head and the main vacuum cleaner body, wherein the dust suction tube is further provided with a conductive component therein, and under the control of the main vacuum cleaner body, the electric power is directed to the dust suction head through the conductive component, so that the dust suction head starts to work.

However, the current dust suction tube is a single tube, and the size and the length of the tube is larger than the lengths or widths of the main vacuum cleaner body and the dust suction head, so it is very inconvenient from the perspective of carrying, and so it is difficult to be favored by consumers; at the same time, it brings great inconvenience to the package for sale.

At the same time, in order to overcome the abovementioned defects, some manufacturers have replaced the dust suction tube with a extending-retracting type, however, it brings a great defect in the process of extending and retracting, that is, the arrangement of the conductive component must enable the conductive component to relatively unfold and collapse following the extending and retracting of the dust suction tube, so the design or structure of the conductive component is very complicated, and further, once a use accident occurs, the maintenance of the conductive component (the built-in of the conductive component) is not convenient.

SUMMARY OF THE INVENTION

The technical problems to be solved by the present disclosure is to overcome the shortcomings of the prior art, and to provide an improved conductive telescopic tube.

And meanwhile, the present disclosure further provides an improved hand-held vacuum cleaner.

To solve the above problems, the present disclosure employs the following technical solution:

A conductive telescopic tube, includes a plurality of sleevings capable of extending-retracting with respect to each other, and conductive assemblies disposed on each of the sleevings and capable of being connected with each other, the conductive assemblies comprise mounting seats disposed on one side of the sleevings along a length direction of each of the sleevings, contact strips disposed along length directions of the mounting seats, and a conductive joint conductively connecting every two adjacent contact strips of the contact strips respectively, wherein every two adjacent mounting seats of the mounting seats are telescopically disposed, two end portions of the conductive joint are respectively located within the two adjacent mounting seats, and capable of always conductively connecting the two adjacent contact strips along with a telescopic movement of the two adjacent mounting seats.

Preferably, mounting grooves are disposed on two sides of each of the mounting seats along the length directions of the mounting seats, the contact strip comprises two conductive sheets disposed within the mounting grooves, respectively, and the two end portions of the conductive joint are connected with the two conductive sheets of the two adjacent contact strips, respectively.

Further, the two conductive sheets are disposed in parallel, and are a positive conductive sheet and a negative conductive sheet, respectively, and the end portions of the conductive joint are located between the positive conductive sheet and the negative conductive sheet to connect the positive conductive sheet and the negative conductive sheet.

According to a specific embodiment and a preferred aspect of the present disclosure, two adjacent mounting seats are a first mounting seat and a second mounting seat, respectively, two adjacent contact strips are a first contact strip and a second contact strip, respectively, one end portion of the conductive joint is disposed within the second mounting seat and conductively connected with the positive conductive sheet and the negative conductive sheet of the second contact strip, and the other end portion of the conductive joint is inserted into the first mounting seat and conductively connected with the positive conductive sheet and the negative conductive sheet of the first contact strip, the other end portion of the conductive joint and the first contact strip move with respect to each other and keep in contact with each other when the first mounting seat and the second mounting seat are relatively extended-retracted.

Preferably, the conductive assemblies further comprises an elastic sheet disposed on the other end portion of the conductive joint and tending to outstretch, two sides of the elastic sheet press against between the positive conductive sheet and the negative conductive sheet of the first contact strip respectively, and conductively connect the positive conductive sheet and the negative conductive sheet of the first contact strip.

According to another specific embodiment and another preferred aspect of the present disclosure, the conductive telescopic tube further comprises a locking mechanism for locking the two sleevings after being adjusted.

Preferably, the two adjacent sleevings are a first tube body and a second tube body, respectively, and the locking mechanism comprises a locking element disposed on the first tube body, a locked portion disposed on the second tube body and an unlocking element, wherein the locking element is locked with the locked portion when the locking mechanism is locked; the locking element is separated from the locked portion when the locking mechanism is unlocked.

Further, the locked portion comprises a recess formed inwardly from a surface of the second tube body and a locking bar disposed within the recess, wherein the recess and the locking bar both extend along a length direction of the second tube body, and the locking bar is provided with a plurality of locking grooves spaced apart along a length direction of the locking bar.

More further, the locking member comprises a locking seat fixed at an end of the first tube body and a locking pin movably disposed in the locking seat, and the unlocking member comprises an unlocking button rotationally disposed in the locking seat by a middle portion and a restoring member disposed between the unlocking button and the locking seat to restore the unlocking button, wherein the locking pin and the restoring member are respectively located at two ends of the unlocking button, and the restoring member is compressed and deformed and the locking pin moves outside the locking seat and disengaged from the locking grooves to achieve unlocking when the unlocking button is pressed; the restoring member recovers from deformation and the locking pin moves towards inside of the locking seat and is inserted into the locking groove to achieve locking when the unlocking button is released.

Another technical solution employed by the present disclosure is as follows:

A hand-held vacuum cleaner, includes a vacuum cleaner body, a dust suction head and a dust suction tube, wherein the dust suction tube is the above-mentioned conductive telescopic tube, the hand-held vacuum cleaner further includes connectors disposed at two end portions of the conductive and telescopic tube respectively and being connected with the vacuum cleaner body and the dust suction head by way of clamping respectively, and conductive plug connectors disposed within the connector respectively, wherein the conductive plug connectors are connected with circuits of the vacuum cleaner body and the dust suction head respectively when the conductive telescopic tube is connected with the vacuum cleaner body and the dust suction head by way of clamping.

Due to the implementation of the above technical solutions, the present disclosure has the following advantages over the prior art:

The invention uses a telescopic type dust suction tube, thereby is convenient to carry, and also reduces the volume of the package for sale, leaves a good impression to the consumer; on the other hand, due to the external arrangement of the conductive component, and the adjacent two contact strips are always electrically connected even when the conductive telescopic tube is being adjusted, the structure is simple, the design is ingenious, and the maintenance and replacement are convenient.

BRIEF DESCRIPTION OF THE DRAWINGS

In the following, the present disclosure is further explained in detail combining with the accompanying drawings and specific embodiments.

DETAILED DESCRIPTION OF EXEMPLARY EMBODIMENTS

Figure 1:
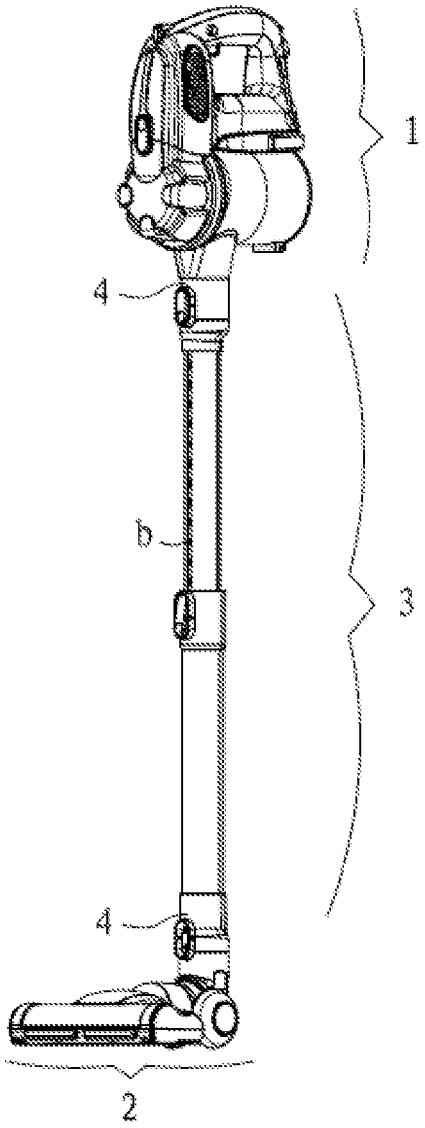
FIG. 1 is a schematic structure diagram of a hand-held vacuum cleaner according to the present disclosure.
Figure 2:
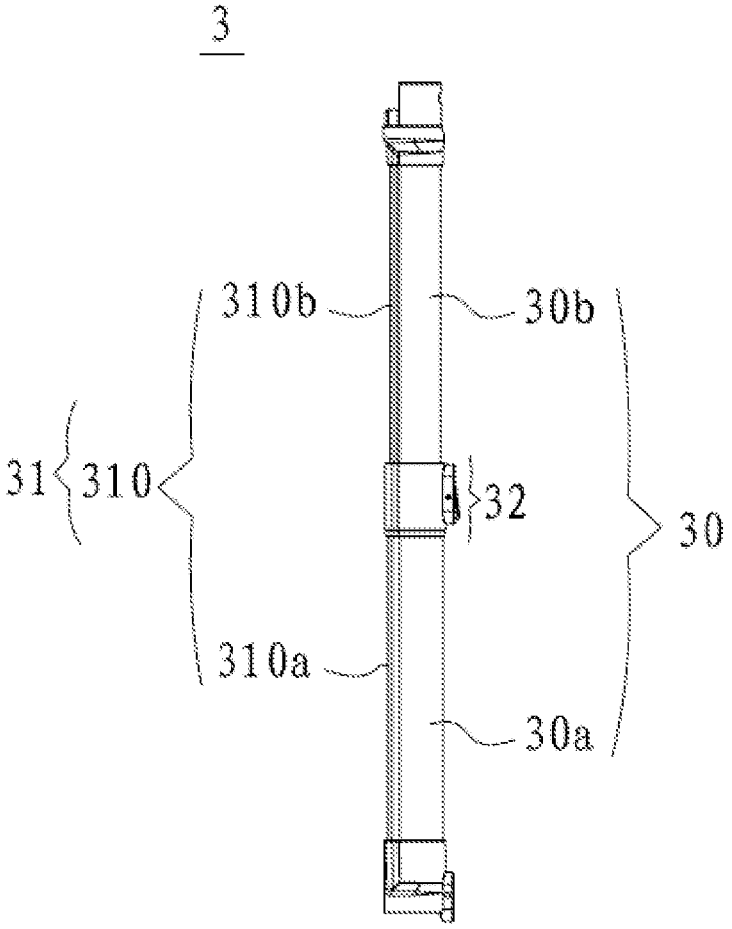
FIG. 2 is a schematic front view of a conductive and telescopic tube according to the present disclosure.
Figure 3:
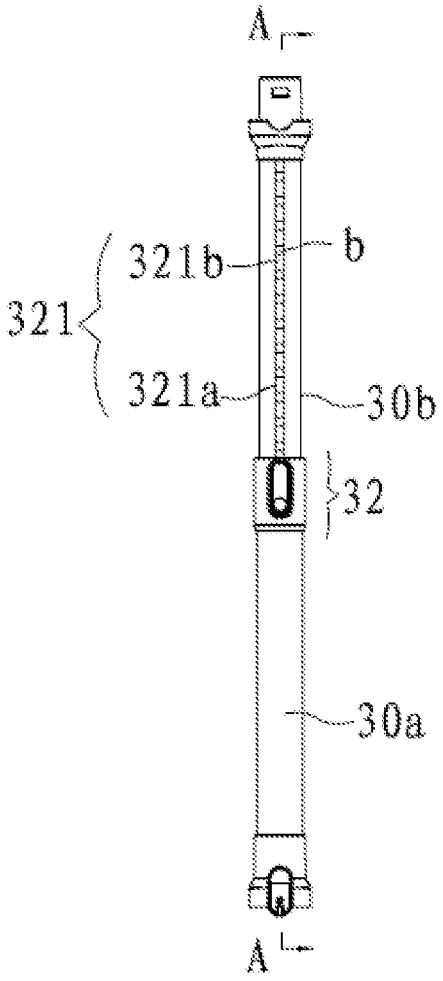
FIG. 3 is a schematic right view of FIG. 2.
Figure 4:
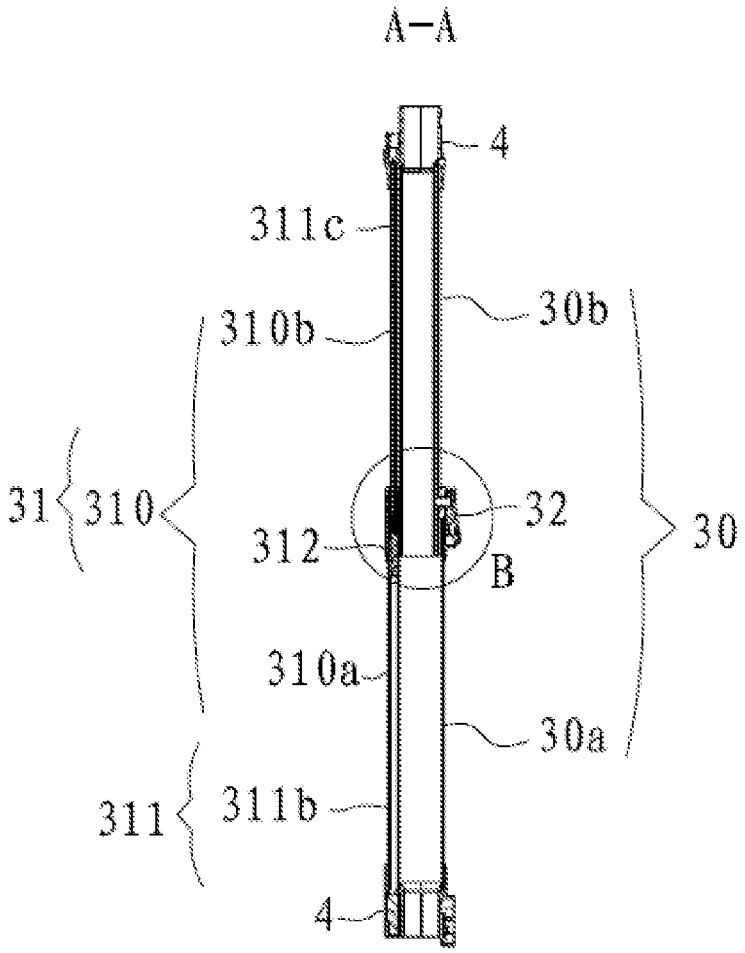
FIG. 4 is a schematic sectional view of Line A-A in FIG. 3.
Figure 5:
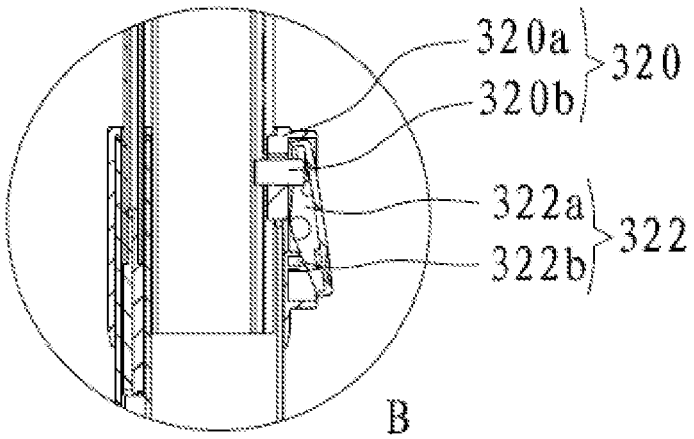
FIG. 5 is an enlarged schematic view of Portion B in FIG. 3.
Figure 6:
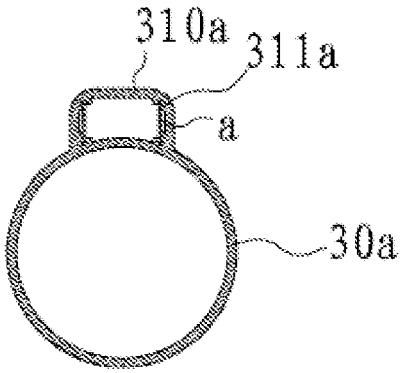
FIG. 6 is a schematic cross sectional view of a conductive and telescopic tube according to the present disclosure.
Figure 7:
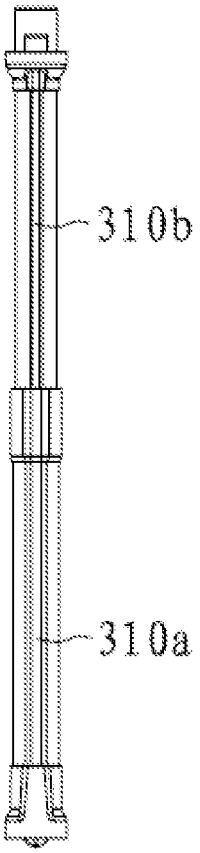
FIG. 7 is a schematic left view of FIG. 2.
Figure 8:
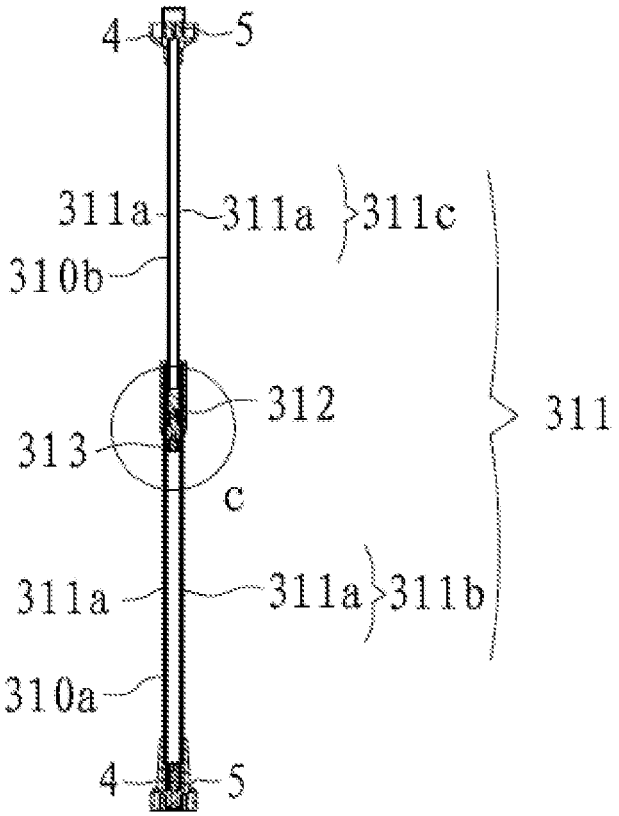
FIG. 8 is a schematic sectional view of a conductive component according to the present disclosure.
Figure 9:
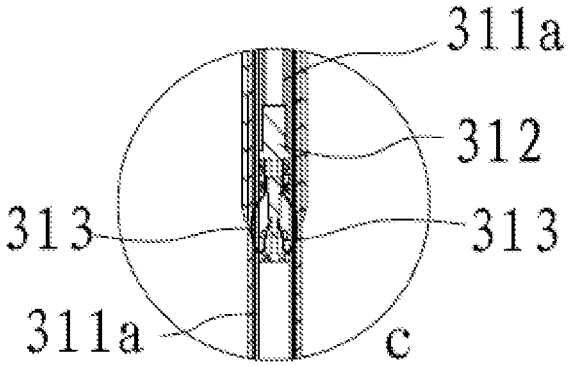
FIG. 9 is an enlarged schematic view of Portion B in FIG. 8.

As shown in FIG. 1 to FIG. 9, a hand-held vacuum cleaner provided by the present embodiment includes s a vacuum cleaner body 1, a dust suction head 2 and a dust suction tube, wherein the dust suction tube is a conductive telescopic tube 3, and two end portions thereof are connected with the vacuum cleaner body 1 and the dust suction head 2 respectively.

In particular, the above-mentioned hand-held vacuum cleaner further includes connectors 4 disposed at the two end portions of the conductive telescopic tube 3 respectively and being connected with the vacuum cleaner body 1 and the dust suction head 2 by way of clamping respectively, and conductive plug connectors 5 disposed within the connector 4 respectively, wherein the conductive plug connectors 5 are linked with circuits of the vacuum cleaner body 1 and the dust suction head 2 respectively when the conductive telescopic tube 3 is connected with the vacuum cleaner body 1 and the dust suction head 2 in a clamping manner respectively.

Further, the conductive and telescopic tube 3 includes a plurality of sleevings 30 capable of telescoping in a relative manner, and conductive assemblies 31 disposed on each sleeving 30 and capable of being connected with each other, and the conductive assemblies 31 include a mounting seat 310 disposed on one side of a sleeving 30 along a length direction of each sleeving 30, a contact strip 311 disposed along a length direction of the mounting seat 310, and a conductive joint 312 conductively connecting each of two adjacent contact strips 311 respectively, wherein each of two adjacent mounting seats 310 is telescopically disposed, two end portions of the conductive joint 312 are respectively located within two adjacent mounting seats 310, and capable of always conductively connecting two adjacent contact strips 311 along with a telescopic movement of the two adjacent mounting seats 310.

In the example, mounting grooves a are disposed on two sides of each mounting seat 310 along its own length direction, the contact strip 311 includes two conductive sheets 311*a* disposed within the mounting grooves, respectively, and the two end portions of the conductive joint 312 are connected with two conductive sheets 311*a* of adjacent two contact strips 311, respectively.

Further, two conductive sheets 311*a* are disposed in parallel, and are a positive conductive sheet and a negative conductive sheet, respectively, and end portions of the conductive joint 312 are located between the positive conductive sheet and the negative conductive sheet to connect the positive conductive sheet and the negative conductive sheet.

Two adjacent mounting seats 310 are a first mounting seat 310*a* and a second mounting seat 310*b*, respectively, two adjacent contact strips 311 are a first contact strip 311*b* and a second contact strip 311*c*, respectively, one end portion of the conductive joint 312 is disposed within the second mounting seat 310*a* and conductively connected with the positive conductive sheet and the negative conductive sheet of the second contact strip 311*c*, and the other end portion thereof is inserted into the first mounting seat 310*b* and conductively connected with the positive conductive sheet and the negative conductive sheet of the first contact strip 311*b*, the other end portion of the conductive joint 312 and the first contact strip 311*b* move with respect to each other and keep in contact with each other when the first mounting seat 310*a* and the second mounting seat 310*b* are relatively telescopic.

In particular, the conductive assemblies 31 further includes an elastic sheet 313 disposed on the other end portion of the conductive joint 312 and tending to outstretch, two sides of the elastic sheet 313 press against the positive conductive sheet and the negative conductive sheet of the first contact strip 311*b* respectively, and conductively connect the positive conductive sheet and the negative conductive sheet of the first contact strip 311*b*.

Meanwhile, the conductive and telescopic tube 3 further includes a locking mechanism 32 for locking two sleevings 30 after being adjusted to telescope in a relative manner.

Two adjacent sleevings 30 are a first tube body 30*a* and a second tube body 30*b*, and the locking mechanism 32 includes a locking element 320 disposed on the first tube body 30*a*, a locked portion 321 disposed on the second tube body 30*b* and an unlocking element 322, wherein the locking element 320 is locked with the locked portion 321 when the locking mechanism 32 is locked; the locking element 320 is separated from the locked portion 321 when the locking mechanism 32 is unlocked.

Further, the locked portion 321 includes a recess 321*a* formed inwardly from a surface of the second tube body 30*b* and a locking bar 321*b* disposed within the recess 321*a*, wherein the recess 321*a* and the locking bar 321*b* both extend along a length direction of the second tube body 30*b*, and the locking bar 321*b* is provided with a plurality of locking grooves b spaced apart along a length direction of the locking bar 321*b*.

More further, the locking member 320 includes a locking seat 320*a* fixed at an end of the first tube body 30*a* and a locking pin 320*b* movably disposed in the locking seat 320*a*, and the unlocking member 322 includes an unlocking button 322*a* rotationally disposed in the locking seat 320*a* by a middle portion and a restoring member 322*b* disposed between the unlocking button 322*a* and the locking seat 320*a* to restore the unlocking button 322*a*, wherein the locking pin 320*b* and the restoring member are respectively located at two ends of the unlocking button 322*a*, and the restoring member 322*b* is compressed and deformed and the locking pin 320*b* moves outside the locking seat 320*a* and disengaged from the locking grooves b to achieve unlocking when the unlocking button 322*a* is pressed; the restoring member 322*b* recovers from deformation and the locking pin 320*b* moves towards inside the locking seat 320*a* and is inserted into the locking groove b to achieve locking when the unlocking button 322*a* is released.

In the present embodiment, the material of the elastic sheets 313, the positive conductive sheets and the negative conductive sheets is copper.

Above all, the present embodiment has the following advantages:

1) The whole dust suction tube is turned into a telescopic type, thereby is convenient to carry, and also reduces the volume of the package for sale, leaves a good impression to the consumer.

2) A unique locking mechanism is employed to lock two telescopic first and second tube bodies with respect to each other, the restoring member is compressed and deformed and the locking pin moves outside the locking seat and disengaged from the locking grooves to achieve unlocking when the unlocking button is pressed; the restoring member recovers from deformation and the locking pin moves towards inside the locking seat and is inserted into the locking groove to achieve automatic locking when the unlocking button is released. The entire process is easy to operate, convenient to implement, and has a low cost.

3) Due to the external arrangement of the conductive component as well as the ability of telescopic movement along with the conductive and telescopic tube, the adjacent two contact strips are always electrically connected, the structure is simple, the design is ingenious, and the maintenance and replacement are convenient.

4) The elastic sheets stretching out with respect to each other are employed, so as to connect the positive conductive sheet and the negative conductive sheet constantly, and poor contact or disconnection is less likely to occur, to ensure the safety use of the vacuum cleaner.

The above detailed describes the present disclosure, and is intended to make those skilled in the art being able to understand the present disclosure and thereby implement it, and should not be concluded to limit the protective scope of this disclosure. Any equivalent variations or modifications according to the spirit of the present disclosure should be covered by the protective scope of the present disclosure.

What is claimed is:

1. A conductive telescopic tube, comprising a plurality of sleevings capable of extending-retracting with respect to each other, and conductive assemblies disposed on each of the sleevings, and capable of being connected with each other, wherein the conductive assemblies comprise mounting seats disposed on one side of the sleevings along a length direction of each of the sleevings, contact strips disposed along length directions of the mounting seats, and a conductive joint conductively connecting every two adjacent contact strips of the contact strips respectively, wherein every two adjacent mounting seats of the mounting seats are telescopically disposed, two end portions of the conductive joint are respectively located within the two adjacent mounting seats, and capable of always conductively connecting the two adjacent contact strips along with a telescopic movement of the two adjacent mounting seats.

2. The conductive telescopic tube according to claim 1, wherein mounting grooves are disposed on two sides of each of the mounting seats along the length directions of the mounting seats, the contact strip comprises two conductive sheets disposed within the mounting grooves, respectively, and the two end portions of the conductive joint are connected with the two conductive sheets of the two adjacent contact strips, respectively.

3. The conductive telescopic tube according to claim 2, wherein the two conductive sheets are disposed in parallel, and are a positive conductive sheet and a negative conductive sheet, respectively, and the end portions of the conductive joint are located between the positive conductive sheet and the negative conductive sheet and connect the positive conductive sheet and the negative conductive sheet.

4. The conductive telescopic tube according to claim 3, wherein the two adjacent mounting seats are a first mounting seat and a second mounting seat, respectively, the two adjacent contact strips are a first contact strip and a second contact strip, respectively, one of the end portions of the conductive joint is disposed within the second mounting seat and conductively connected to the positive conductive sheet and the negative conductive sheet of the second contact strip, and the other of the end portions of the conductive joint is inserted into the first mounting seat and conductively connected to the positive conductive sheet and the negative conductive sheet of the first contact strip, said other end portion of the conductive joint and the first contact strip move with respect to each other and keep in contact with each other when the first mounting seat and the second mounting seat are relatively extended-retracted.

5. The conductive telescopic tube according to claim 4, wherein the conductive assemblies further comprises an elastic sheet disposed on said other end portion of the conductive joint and tending to outstretch, two sides of the elastic sheet press against the positive conductive sheet and the negative conductive sheet of the first contact strip respectively, and conductively connect the positive conductive sheet and the negative conductive sheet of the first contact strip.

6. The conductive telescopic tube according to claim 1, wherein the conductive telescopic tube further comprises a locking mechanism for locking the two sleevings after being adjusted.

7. The conductive telescopic tube according to claim 6, wherein the two adjacent sleevings are a first tube body and a second tube body, respectively, and the locking mechanism comprises a locking element disposed on the first tube body, a locked portion disposed on the second tube body and an unlocking element, wherein the locking element is locked with the locked portion when the locking mechanism is locked; the locking element is separated from the locked portion when the locking mechanism is unlocked.

8. The conductive telescopic tube according to claim 7, wherein the locked portion comprises a recess formed inwardly from a surface of the second tube body and a locking bar disposed within the recess, wherein the recess and the locking bar both extend along a length direction of the second tube body, and the locking bar is provided with a plurality of locking grooves spaced apart along a length direction of the locking bar.

9. The conductive telescopic tube according to claim 8, wherein, the locking element comprises a locking seat fixed at an end of the first tube body and a locking pin movably disposed in the locking seat, and the unlocking element comprises an unlocking button rotationally disposed in the locking seat by a middle portion and a restoring member disposed between the unlocking button and the locking seat to restore the unlocking button, wherein the locking pin and the restoring member are respectively located at two ends of the unlocking button, and the restoring member is compressed and deformed and the locking pin moves outside the locking seat and disengaged from the locking grooves to achieve unlocking when the unlocking button is pressed, the restoring member recovers from deformation and the locking pin moves towards inside of the locking seat and is inserted into the locking groove to achieve locking when the unlocking button is released.

10. A hand-held vacuum cleaner, comprising a vacuum cleaner body, a dust suction head and a dust suction tube, wherein the dust suction tube is the conductive telescopic tube of claim 1, the hand-held vacuum cleaner further comprises connectors disposed at two end portions of the conductive telescopic tube respectively and being connected with the vacuum cleaner body and the dust suction head by way of clamping respectively, and conductive plug connectors disposed within the connectors respectively, wherein the conductive plug connectors are connected with circuits of the vacuum cleaner body and the dust suction head respectively when the conductive telescopic tube is connected with the vacuum cleaner body and the dust suction head by way of clamping respectively.

* * * * *